United States Patent [19]

Faul et al.

[11] 4,269,678

[45] May 26, 1981

[54] METHOD FOR REGENERATING A CUPRIC CHLORIDE AND/OR FERRIC CHLORIDE CONTAINING ETCHING SOLUTION IN AN ELECTROLYSIS CELL

[75] Inventors: Wolfgang Faul, Jülich; Bertel Kastening, Hamburg; Harald Luft, Niederzier-Hambach, all of Fed. Rep. of Germany

[73] Assignee: Kernforschungsanlage Jülich Gesellschaft mit beschrankter Haftung, Jülich, Fed. Rep. of Germany

[21] Appl. No.: 96,136

[22] Filed: Nov. 20, 1979

[30] Foreign Application Priority Data

Nov. 22, 1978 [DE] Fed. Rep. of Germany ..... 2850564

[51] Int. Cl.[3] ..... C25F 3/14; C25F 7/02

[52] U.S. Cl. ..... 204/129.6; 204/129.75; 204/130

[58] Field of Search ..... 204/129.1, 129.6, 129.75, 204/129.8, 130

[56] References Cited

U.S. PATENT DOCUMENTS

| | | | |
|---|---|---|---|
| 3,788,915 | 1/1974 | Gulla | 204/130 |
| 3,974,050 | 8/1976 | Divisek | 204/129.6 |
| 4,131,523 | 12/1978 | Faul | 204/129.1 |
| 4,153,531 | 5/1979 | Faul | 204/275 |

*Primary Examiner*—T. M. Tufariello

*Attorney, Agent, or Firm*—Becker & Becker, Inc.

[57] ABSTRACT

Method and apparatus for regenerating etching solutions obtained by chemically processing metallic surfaces, which solutions contain cupric chloride and/or ferric chloride. The apparatus includes between the anode and the cathode a diaphragm or an ion exchange membrane. The etching solution is passed through the electrolysis cell for anodic oxidation of the cuprous and/or ferrous ions obtained by etching of the metallic surface of a workpiece. An effective quantity of activated pulverous carbon particles is suspended at least in the anode compartment of the electrolysis cell, which cell is in communication with an etching chamber in such a way so as to allow circulating flow of solution.

8 Claims, 1 Drawing Figure

Figure 1:
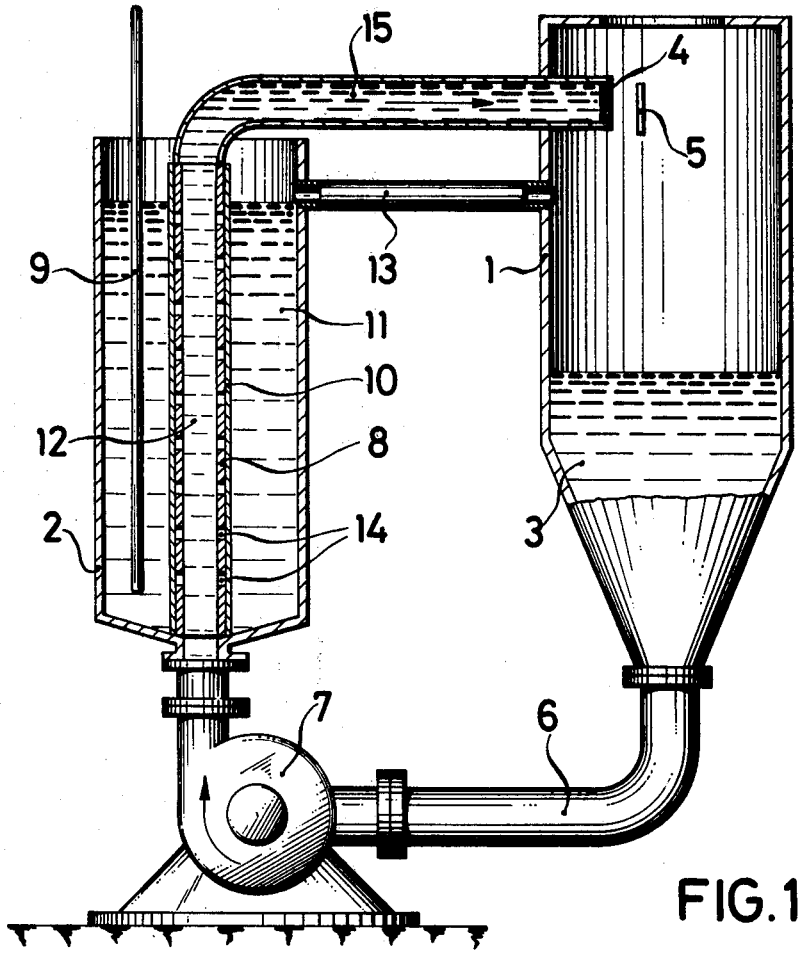

METHOD FOR REGENERATING A CUPRIC CHLORIDE AND/OR FERRIC CHLORIDE CONTAINING ETCHING SOLUTION IN AN ELECTROLYSIS CELL

The present invention relates to a method for regenerating a solution for electrochemically processing metallic surfaces of workpieces, which solution contains cupric chloride and/or ferric chloride, in an electrolysis cell, which has a diaphragm or an ion exchange membrane between the anode and the cathode, through which cell a used etching solution is passed for anodically oxidizing the cuprous and/or ferrous ions obtained by etching of the metallic surfaces. The invention also relates to an apparatus for carrying out the method of regenerating such a used solution.

Cupric chloride and/or ferric chloride are known as oxidizing agents in etching solutions for processing metallic surfaces. They are used in the manufacture of conductor plates or printed circuits. This manufacture involves plates of plastic or synthetic material which are provided on at least one side with a copper coating or layer which is removed by the etching solution in accordance with a template or coating which protects those parts of the copper layer which are to remain to be effective in the resultant circuitry. Such solutions are also used in the production of a surface pattern for printing rollers or cylinders. Aside from surfaces of copper or copper alloys, also steel and other hard metal surfaces are treated with etching solutions.

In order to render those methods economically viable, used or spent etching solutions are regenerated and reconditioned, as described, for example, by Bruch et al. in "Leiterplatten", (conductor plates), Leuze Verlag, Saulgau, 1978 (Germany). Particularly in the case when etching copper surfaces, it is desirable to recover copper contained in an etching solution.

Electrochemical processes are useful for a continuous reconditioning of the etching solution whereby the etching solution is introduced into an electrolysis cell, and the oxidation agent for etching is regenerated at the anode of the electrolysis cell. When ferric chloride ($FeCl_3$) is used as the etching agent, the ferrous chloride ($FeCl_2$), formed during etching, is oxidized to ferric chloride. Etching solutions which contain cupric chloride ($CuCl_2$) as the oxidation agent can be regenerated in a similar manner. Cuprous chloride (CuCl) or ferrous chloride, contained in the electrolyte solution after treating of the pertaining copper surface, is passed to the anode of the electrolysis cell to be converted again into cupric chloride or ferric chloride. It is disadvantageous in such processes, however, that chlorine is produced at the anode which leads to substantial environmental problems and to consumption of the oxidizing agent.

In order to prevent the formation of chlorine gas, it is known to regenerate an etching solution, containing copper chloride or ferric chloride as the oxidizing agent, by introducing it into the cathode compartment of an electrolysis cell, while adding hydrochloric acid and hydrogen peroxide. In such an electrolysis cell the anode compartment is separated from the cathode compartment by means of a diaphragm. The anode compartment contains a sodium hydroxide solution. The sodium hydroxide serves to absorb or receive the chlorine which is produced at the anode during regeneration of the etching solution. This chlorine reacts with the sodium hydroxide while forming sodium hypochlorite. A high consumption of chemicals is disadvantageous in this method. Aside from sodium hydroxide also hydrochloric acid and hydrogen peroxide have to be added in order to maintain the etching conditions constant in the etching chamber. The toxic effect of the sodium hypochlorite formed in the anode compartment is furthermore disadvantageous since it requires further treatment.

A further method has become known for regenerating an etching solution, containing copper chloride as oxidizing agent, in an electrolysis cell. To prevent the formation of chlorine gas at the anode, the copper content of the etching solution to be regenerated and the ratio of cuprous ions to cupric ions is limited within a narrow range. In addition, high current densities are necessary in the electrolysis cell. Aside from the considerable efforts for a control to adjust the predetermined concentration limits, as a result, also the deposition at the cathode of the electrolysis cell, of the copper etched away, is difficult. Generally, only sludge-like precipitates are formed.

It is accordingly an object of the present invention to regenerate an etching solution by introduction thereof into an electrolysis cell while avoiding the formation of chlorine in such a way that no toxic substances, which would deleteriously affect the environment, are produced.

It is furthermore an object of the present invention to provide a method which is easily carried out.

It is still another object of this invention to provide an apparatus for carrying out the method of the invention.

These objects and other objects and advantages of the invention will appear more clearly from the following specification in connection with the accompanying drawing, in which:

the single FIGURE diagrammatically indicates an apparatus for carrying out the method of the present invention.

The method of the present invention is characterized primarily therein that an effective amount of activated pulverous carbon particles is suspended at least in the anode compartment of the electrolysis cell.

The pulverous activated carbon particles suspended in the etching solution in the anode compartment of the electrolysis cell react with the chlorine, which chlorine results after regeneration of the oxidizing agent, while forming chloride ions, whereby the activated carbon powder is oxidized. The respective concentrations of cupric chloride and/or ferric chloride in the etching solution can be maintained relatively high in the presence of the active carbon particles. It is furthermore of advantage that metal coated workpieces which are etched with an etching solution in accordance with the present invention exhibit only a low extent of underetching (side etching) of the covered or protected surface regions. The metals removed by the etching agent, which metals are dissolved in the solution, are recoverable at the cathode of the electrolysis cell which cathode is separated from the anode compartment by a diaphragm or an ion exchange membrane. The diaphragm or ion exchange membrane is impermeable to the activated carbon powder. This is particularly of economic importance in the recovery of copper.

Activated pulverous carbon powder of a concentration of from about 5 to 24% by weight is preferred to be added to the etching solution. It is furthermore preferred to add activated carbon powder which has been heat treated in a vacuum at a temperature of from about 900° to about 1200° C., whereby heat treating can be carried out in an inert atmosphere or in a reducing atmosphere, with the heat treating being preferably carried out for about at least one hour.

The apparatus in accordance with the present invention is characterized primarily therein that in the anode compartment of the electrolysis cell the etching solution contains suspended in it activated pulverous carbon particles.

The etching solution containing activated pulverous carbon particles or activated carbon powder particles is circulated in a circuit including the etching chamber and the anode compartment of the electrolysis cell, so that at a continuous etching with an etching solution which remains constant in composition, particularly in the case of working of copper-containing surfaces, a continuous recovery of the copper will be possible. Dissolved copper is separated at the cathode of the electrolysis cell.

The invention will be further described with reference to the accompanying drawing and on the basis of the examples.

As indicated in the drawing, the apparatus includes an etching chamber 1 and an electrolysis cell 2. An etching solution 3 is circulated through the apparatus.

In the etching chamber 1 the etching solution is brought into contact, by means of a spray nozzle 4, with the surface of a workpiece 5 which is to be processed in the apparatus. The spent or used solution flows to the bottom of the etching chamber 1. By suction it is brought from here through a suction line or conduit 6, by means of a pump adapted to convey the solution, this pump generally designated by the numeral 7, and is pumped into the electrolysis cell 2. A partition 10, either a diaphragm or ion exchange membrane, is positioned in the electrolysis cell 2 between the pertaining anode 8 and the pertaining cathode 9, so that there is provided a cathode compartment 11 and an anode compartment 12 which are separated by the partition 10. An overflow conduit 13 for the solution contained in the cathode compartment is arranged at the cathode compartment 11. This overflow conduit 13 is in communication with the etching chamber 1. In the embodiment shown, the anode 8 is made of graphite and has a tubular configuration, whereby etching solution can flow through the tubular anode. The wall of the graphite tube is provided with bores or passages 14 which allow movement of the etching solution so as to contact the diaphragm or the ion exchange membrane and to allow for ion exchange between the anode compartment 12 and the cathode compartment 11. The oxidizing agent of the etching solution is regenerated at the anode 8, while copper, removed from the workpiece 5 when the surface of the workpiece is comprised of copper or a copper alloy, is recoverable at the cathode 9. The regenerated etching solution flows through the anode compartment 12 and through a pressure line or conduit 15 again into the etching chamber 1.

EXAMPLE 1

In etching solutions with varying iron chloride content, there were suspended activated pulverous carbon particles of a concentration of 15% by weight, based on the weight of the etching solution. A total of 1.4 liter etching solution was circulated through the apparatus. At the graphite anode a constant current of 5 A was maintained by means of a supply of constant current. Etching solution at a temperature of about 50° C. was removed from the anode compartment and was sprayed at a pressure of about 1.5 bar, by means of nozzle 4, from a distance of about 4 cm onto a stainless steel sheet.

The weight loss per minute of the stainless steel sheet as a function of the iron content in the etching solution was measured.

At an iron content of 5 g/l in the etching solution, stainless steel was removed by etching at a rate of 42 mg/min. The etching velocity increased as the iron content of the solution increased; at an iron content of 50 g/l the metal removal rate was 221 mg/min. During all tests, even after complete oxidation of ferrous ions to ferric ions, at a constant current of 5 A, no escape of chlorine from the electrolysis cell could be observed. The weight loss of activated pulverous carbon particles during the test period of 5 hours was below 1%.

EXAMPLE 2

In an etching solution containing copper chloride there were suspended 15% by weight of activated pulverous carbon particles. 1.4 liter of etching solution were circulated through the apparatus in the manner described in the foregoing example. At the graphite anode a constant current of 5 A was maintained. Etching solution removed from the anode compartment of the electrolysis cell was heated to a temperature of about 50° C. and was sprayed onto a copper sheet at a pressure of 1.5 bar by means of the nozzle 4.

Even after complete oxidation of cuprous ions to cupric ions, at a constant current of 5 A, no chlorine gas development was observed at the electrolysis cell. After 5 hours of operation the weight loss of activated pulverous carbon particles was below 1%.

A development of chlorine after regeneration of an iron and copper chloride containing etching solution, in which activated pulverous carbon particles were suspended, could not be noticed, even after the addition of 1 Mol/l sodium chloride.

The present invention is, of course, in no way restricted to the specific disclosure of the specification and drawing, but also encompasses any modifications within the scope of the appended claims.

What we claim is:

1. A method of regenerating a chloride-containing etching solution for electrochemically processing surfaces of workpieces without development of chlorine gas at anode locations, comprising in combination the steps of:

providing an electrolysis cell having an anode compartment with a pertaining anode, a cathode compartment with a pertaining cathode, and a partition between said anode compartment and said cathode compartment;

providing in said anode compartment a solution containing at least one of the group consisting of cupric chloride and ferric chloride;

processing a workpiece surface with said solution, resulting in a used solution containing ions selected from the group consisting of $Cu^{+}$ and $Fe^{++}$;

suspending an effective amount of activated pulverous carbon particles that specifically preclude chlorine gas development even after complete oxidation of metallic ions or cations at least in said anode compartment of the electrolysis cell; and regenerating said used solution by passing it through said electrolysis cell again and anodically completely oxidizing cations to provide a regenerated solution.

2. A method in combination according to claim 1, wherein said partition is a diaphragm.

3. A method in combination according to claim 1, wherein said partition is a membrane adapted to effect ion exchange.

4. A method in combination according to claim 1, wherein said suspending step is carried out in such a way that a concentration of from about 5 to about 25% by weight of activated pulverous carbon particles are suspended.

5. A method in combination according to claim 1, and including the step of heat treating said activated pulverous carbon particles in a vacuum at a temperature of from about 900° to about 1200° C. prior to said suspending step.

6. A method in combination according to claim 5, wherein said heat treating step is carried out in an inert atmosphere.

7. A method in combination according to claim 5, wherein said heat treating step is carried out in a reducing atmosphere.

8. A method in combination according to claim 5, wherein said heat treating step is carried out for at least one hour.

* * * * *